US005424795A

United States Patent [19]

Endo

[11] Patent Number: 5,424,795

[45] Date of Patent: Jun. 13, 1995

[54] X-RAY FILM DEVELOPING DEVICE

[75] Inventor: Tetsuya Endo, Yokohama, Japan

[73] Assignee: Tokyo Emix Corporation, Misato, Japan

[21] Appl. No.: 73,182

[22] Filed: Jun. 7, 1993

[30] Foreign Application Priority Data

| | | | |
|---|---|---|---|
| Jun. 9, 1992 | [JP] | Japan | 4-174738 |
| Jun. 9, 1992 | [JP] | Japan | 4-174739 |
| Jun. 9, 1992 | [JP] | Japan | 4-174740 |
| Jun. 9, 1992 | [JP] | Japan | 4-174741 |
| Jun. 9, 1992 | [JP] | Japan | 4-174742 |
| Sep. 29, 1992 | [JP] | Japan | 4-285281 |

[51] Int. Cl.[6] ..... G03D 17/00

[52] U.S. Cl. ..... 354/308; 354/312; 354/316

[58] Field of Search ..... 354/308, 310, 312, 324, 354/328–330, 315, 316, 313, 319–322

[56] References Cited

U.S. PATENT DOCUMENTS

| | | | |
|---|---|---|---|
| 2,933,032 | 4/1960 | Pardee | 354/322 |
| 3,314,352 | 4/1967 | Grant | 354/308 |
| 3,462,221 | 8/1969 | Tajima | 355/77 |
| 3,492,932 | 2/1970 | Baerle | 354/322 |
| 3,559,553 | 2/1971 | Buechner | 354/322 |
| 3,724,353 | 4/1973 | Holbert | 354/313 |
| 4,502,772 | 3/1985 | Mihara | 354/312 |

*Primary Examiner*—D. Rutledge

*Attorney, Agent, or Firm*—Lackenbach Siegel Marzullo Aronson & Greenspan

[57] ABSTRACT

The present invention is provided with a film holding means, a plural of vessels, processing condition setting means for setting the processing condition corresponding to the qualitative state of the processing solution in each of the vessels, and film processing and transferring means for processing and transferring the undeveloped film, making it possible to prevent film injury and to perform the most appropriate film developing process independent of experience and skill, by holding the film, submerging the film in each of the vessels, shuffling the film in each of the vessels, and setting the processing condition corresponding to the qualitative state of each processing solution.

8 Claims, 10 Drawing Sheets

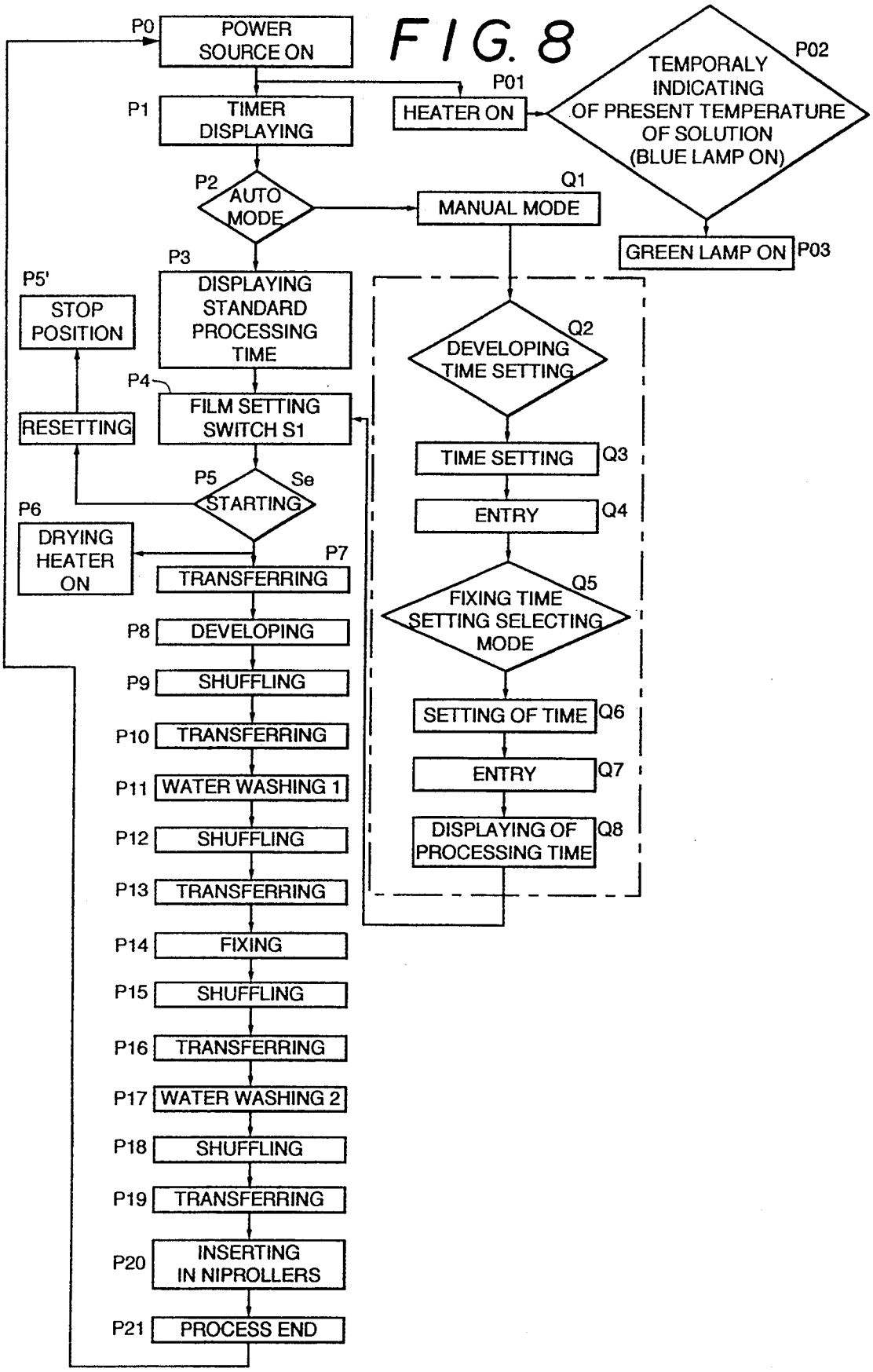
FIG. 8
P0
POWER SOURCE ON
P1
TIMER DISPLAYING
P01
HEATER ON
P02
TEMPORALY INDICATING OF PRESENT TEMPERATURE OF SOLUTION (BLUE LAMP ON)
P03
GREEN LAMP ON
P2
AUTO MODE
Q1
MANUAL MODE
P3
DISPLAYING STANDARD PROCESSING TIME
P4
FILM SETTING SWITCH S1
P5'
STOP POSITION
RESETTING
P5
Se
STARTING
P6
DRYING HEATER ON
P7
TRANSFERRING
P8
DEVELOPING
P9
SHUFFLING
P10
TRANSFERRING
P11
WATER WASHING 1
P12
SHUFFLING
P13
TRANSFERRING
P14
FIXING
P15
SHUFFLING
P16
TRANSFERRING
P17
WATER WASHING 2
P18
SHUFFLING
P19
TRANSFERRING
P20
INSERTING IN NIPROLLERS
P21
PROCESS END
Q2
DEVELOPING TIME SETTING
TIME SETTING
Q3
ENTRY
Q4
Q5
FIXING TIME SETTING SELECTING MODE
SETTING OF TIME
Q6
ENTRY
Q7
DISPLAYING OF PROCESSING TIME
Q8

X-RAY FILM DEVELOPING DEVICE

BACKGROUND OF THE INVENTION

The present invention relates to a film developing device and, more particularly, to an X-ray film developing device for industrial application in medical and technological fields.

Usually, in developing undeveloped X-ray film (hereafter called simply "film"), the film is removed from a package sealing the film therein by groping in the dark room, then sequentially submerged in a developing solution, first washing water, a fixing solution and second washing water, and shuffled by hand by so called snap actions or shuffling operations while submerged in these solutions and water. If any of these solutions have deteriorated, an operator usually makes adjustments according to experience and sixth sense. However, when developing by hand, considerable time, labor and experienced skill are required. In consideration of the above-mentioned drawback, recent miscellaneous film developing devices eliminating man power as much as possible have been proposed.

Up to the present, patent application No. Showa 63(1988)-173191 is publicly laid open as an example of such a proposed film developing device. This film developing device is provided with a plurality of vessels installed in a dark chamber, and the vessels are filled with developing solution, fixing solution and washing water and each vessel has an opening opened upwardly and the device is provided with a plurality of nip rollers. When developing the film, the film is first removed from the sealed package by groping in the dark chamber, then clipped in a plurality of the nip rollers and successively and horizontally fed in the processing solutions such as developing or fixing solutions at a constant speed.

When the processing solutions deteriorate, the solutions are disposed of as they are. When deteriorated solutions are reused, the developing time and fixing time are usually determined according to the operator's experience and sixth sense in accordance to the stage of deterioration of the processing solutions.

Further, when drying washed film, the film is stripped away from the drops of water while passing through a pair of rollers that contact each other, then discharged toward the outside, or by feeding hot air toward the vicinity of the rollers, the film is stripped away from drops of water and dried, then the hot air is discharged from the film ejection port.

However, in such conventional film developing devices, as the film is clipped between the nip rollers, gelatin membrane coated on the surface of the film is injured, and since the time of film contact with the developing and fixing solutions is too short, it is always necessary to apply fresh developing and fixing solutions to the film. This agitating operation in processing solutions is cumbersome.

Furthermore, as the film is handled by groping in the dark chamber, it is unclear whether the film is correctly clipped by the pair of rollers, and occasionally the film is injured or contaminated by being dropped, and considerable time and labor are required in order to cautiously handle and process the film by hand.

As the upper openings of vessels are usually opened in the dark chamber and developing and fixing solutions are heated in order to process the film at an adequate temperature, the vapors generated from the solutions fill the dark chamber. The vaporized drips adhere around the inner wall of the dark chamber, contaminating the film that comes in contact with vaporized drips in the developing process, and also oxidizing and contaminating the developing and fixing solutions by contact with the air in the dark chamber.

When lifting the film above the vessels, as the processing solutions adhering to the film are also transferred into the next vessel, processing solutions in the vessels are apt to decrease and the solution in the next vessel also becomes contaminated.

Furthermore, as the film is simultaneously stripped from the drops of water between a pair of rollers, imperfect stripping and drying are apt to occur, and as hot air for drying the film is discharged outwardly after the film is heated as it is, the film is inefficiently and insufficiently dried.

Furthermore, as the film is force-fed in the processing solutions at a constant speed, hand-shuffling is impossible, and desired developing effects are unattainable. Also, as the contaminated solutions are disposed of as they are, the amount of processing solutions consumed becomes much larger, and considerable amounts are rendered futile. In addition, as the developing time and the film processing condition in the processing solution are sometimes determined by experience according to the qualitative change (deterioration) of the processing solution, selecting the best processing time is difficult, and the film developing results are apt to be different according to the degree of the operator's experience.

The first object of the present invention is to provide a film developing device enabling the undeveloped X-ray film to be easily developed in the preferred best condition by providing a plural of the vessels filled with specified processing solutions, means for setting a processing condition corresponding to the qualitative state of the processing solution, and another means for processing and transferring the film, by presetting the above-mentioned processing condition and by submerging the film in each of the vessels, and further by shuffling the film in each of the vessels.

The second object of the present invention is to provide a film developing device enabling X-ray film to be clipped by a plurality of film holding means in a dark chamber, to detect and display the film clipped securely in the film holding means, and to confirm whether the film is correctly clipped by the holding means or not, by providing a guide plate for introducing the film, a plurality of the film holding means and a sensor for detecting the condition in which the film is held in the device and by letting the film be clipped in the holding means by only one touch of the film.

The third object of the present invention is to provide a film developing device enabling the X-ray film to prevent deterioration due to the processing solutions, and also to prevent the contamination of the solutions, by simultaneously opening vessel covers which usually and respectively close the upper openings of the vessels, only in the developing operation by activating the cover opening means.

The fourth object of the present invention is to provide a film developing device enabling the X-ray film to be dried effectively in a short time by providing two pairs of rollers revolving in the higher peripheral speed than the transferring speed of the film and drying means for discharging hot air toward the discharging port of the device together with the dried film.

The fifth object of the invention is provided a film developing device enabling automatic control of the film processing and transferring means in accordance with specified processing conditions directed by an operator or in accordance with the processing condition in the solutions corresponding to the state of deterioration of the processing solutions, to perform the identical shuffling operation as that performed during hand developing, and to select easily the appropriate developing operation, by providing means for transferring and processing the X-ray film and one more means for controlling the above-mentioned means, in the device.

The sixth object of the present invention is to provide a film developing device which prevents contamination of the film by the processing solutions, prevents deterioration of the processing solutions themselves, minimizes the consumption of processing solutions by wiping away the adhered drops on the film with a pair of wipers while lifting the film from each of the vessels, and prevents deterioration of the processing solution filled in the next vessel, by providing opening means for opening a pair of wipers individually and normally being closed, only during the developing process.

SUMMARY OF THE INVENTION

A film developing device according to the present invention which removes undeveloped X-ray film from a sealed package in the dark chamber of the device and sequentially performs developing, fixing and drying processes, comprised with: a plurality of vessels filled with specified processing solutions, parallely located in the processing order on the bottom of the device; processing condition setting means for setting the specified condition corresponding to the qualitative state of processing solution filled in each of the vessels; film processing and transferring means installed near vessels for sequentially transferring the film removed toward the vessels, in accordance with the above-mentioned processing condition, and for shuffling the film in each of the vessels.

Accordingly, in this developing device, as the proper processing condition corresponding to the qualitative state of the processing solution filled in each of the vessels is able to be set up by activating the above-mentioned processing condition setting means, the film processing and transmitting means is operated in accordance with the set condition, and the film is shuffled while submerged in each of the vessels.

Further, a film developing device according to the present invention which removes the undeveloped X-ray film from the sealed package in the dark chamber of the device and sequentially performs developing, fixing and drying processes is comprised with: a film holding condition detecting sensor installed on the guide plate for detecting if the film is held in the holding means; and displaying means for displaying the detected condition by signals transmitted from the sensor.

Accordingly, in this developing device, the film is held in the holding means with one movement of the film by raising the film along the guide plate, and the sensor detects that the film is properly held in the holding means, while the display means displays the condition of the held film.

Further, a film developing device according to the present invention which removes the undeveloped X-ray film from the sealed package in the dark chamber of the device and sequentially performs developing, fixing and drying processes is further comprised with: a plurality of vessels parallely placed on the bottom of the above-mentioned dark chamber in the order of film processing, each of the vessels being filled with developing solution or fixing solution or washing water and each of the vessels having an opening opened toward the dark chamber on the upper portion of the vessel; and cover opening means for simultaneously opening each of the vessels.

Accordingly in this developing device, the opening of each of the vessels is normally closed by each of these covers, and in the developing and fixing process, by simultaneously opening each opening of the vessels, it is possible to return the drop of water adhering to the inner surfaces of the covers into each of the vessels by opening each cover.

A film developing device according to the present invention which removes the undeveloped X-ray film from the sealed package in the dark chamber of the device and sequentially performs developing, fixing and drying processes is also comprised with: a plurality of vessels parallely located on the bottom of the dark chamber in the order of processing, each of the vessels filled with each of the specified processing solutions; film processing and transferring means installed near those vessels for sequentially transferring the film removed from the package in the down stream direction of the process and for submerging the film in each of solutions for drying the film; two pairs of nip rollers installed next to the vessel positioned in the foremost down stream of the process, and extended rectangularly to the processing direction, and revolving at a higher speed than that of the film transferred toward the displaying direction; and drying means for supplying hot air to the space between two pairs of the nip rollers.

Accordingly, in this film developing device, the film is transferred between the upper placed nip rollers by the film processing and transferring means, then the drops of water adhering to the film are removed with the nip rollers revolving at a higher speed than that of the film transferred, while passing through the above pair of rollers.

The film is subsequently dried by hot air supplied in the space between two pairs of the nip rollers, and finally discharged downwardly by the pair of nip rollers placed at a lower position.

Furthermore, a film developing device according to the present invention which removes the undeveloped X-ray film from the sealed package in the dark chamber of the device and sequentially performs developing, fixing and drying processes is further comprised with: a plurality of vessels which are parallel installed on the bottom of the dark chamber in the order of processing, each of the vessels filled with each of the specified processing solutions; film processing and transferring means installed near those vessels for sequentially transferring the film removed from the package in the down stream direction of the processes, and for submerging the film in each of the processing solutions; operation controlling means for controlling the film processing and transferring means in accordance with either film shuffling conditions specified in a standard processing condition or a special processing condition determined by the operator's direction in accordance with the present qualitative state of the processing solution in each of the vessels.

Accordingly, in this film developing device, the operation controlling means controls the film processing and transferring means, and the film is developed by the standard processing condition corresponding to the present qualitative state of the processing solution in each of the vessels, or by the special processing condition determined by the operator's direction.

A film developing device according to the present invention which removes the undeveloped X-ray film from the sealed package in the dark chamber of the device and sequentially performs developing, fixing and drying processes is further comprised with a plural of vessels which are parallely installed on the bottom of the dark chamber in the order of process, and are filled with each of the developing and fixing solutions, each vessel having an opening opened to the dark chamber; and cover opening means having a pair of wipers individually opening each vessel opening from both sides of the opening.

Accordingly, in this film developing device, since a pair of wipers usually closes each of the opening vessels, and the openings are opened only while the film is developed and fixed, the film is held between the wipers when lifting the film, and the processing solution adhering to the film is returned into each of the vessels, the amount adhering to the film is minimized.

BRIEF DESCRIPTION OF THE DRAWINGS

FIG. 8 is a flow diagram of the microcomputer built in the embodiment shown in FIG. 1.

DETAILED DESCRIPTION OF THE INVENTION

The foregoing and other objects, features and advantages of the present invention will become more apparent from a reading of the following detailed description in connection with the accompanying drawings.

Figure 1:
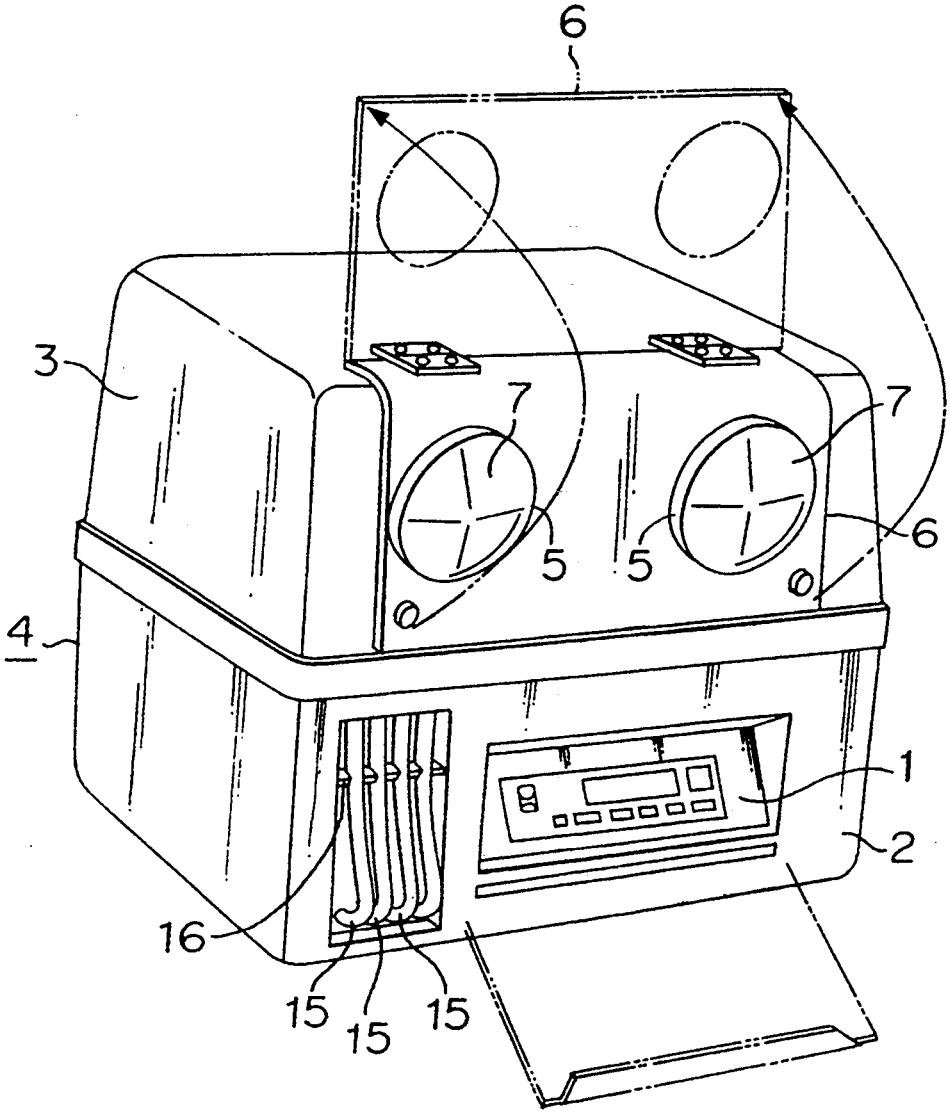
FIG. 1 is a perspective view of the embodiment of the film developing device according to the present invention.
Figure 2:
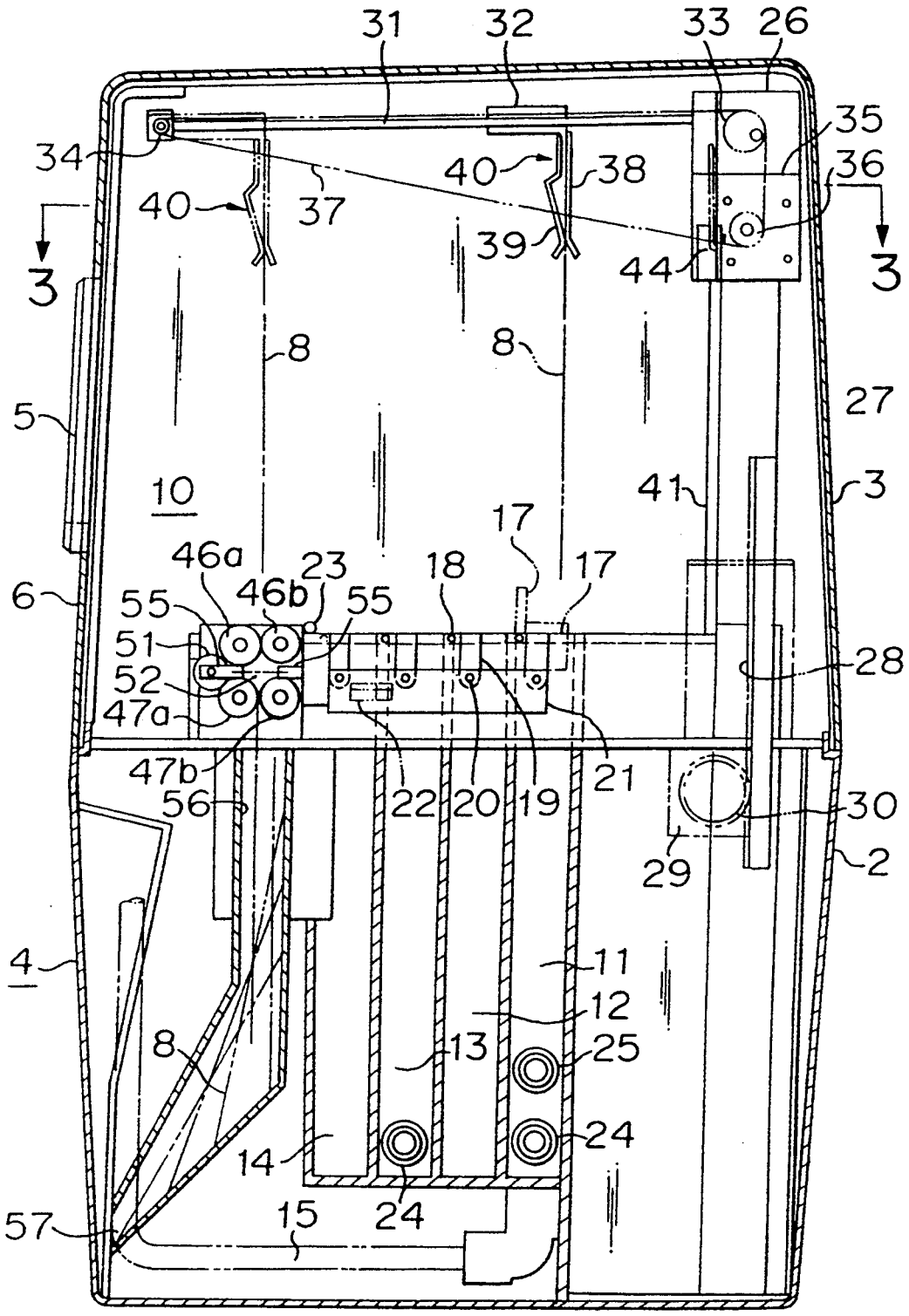
FIG. 2 is a side sectional view of the embodiment shown in FIG. 1.
Figure 3:
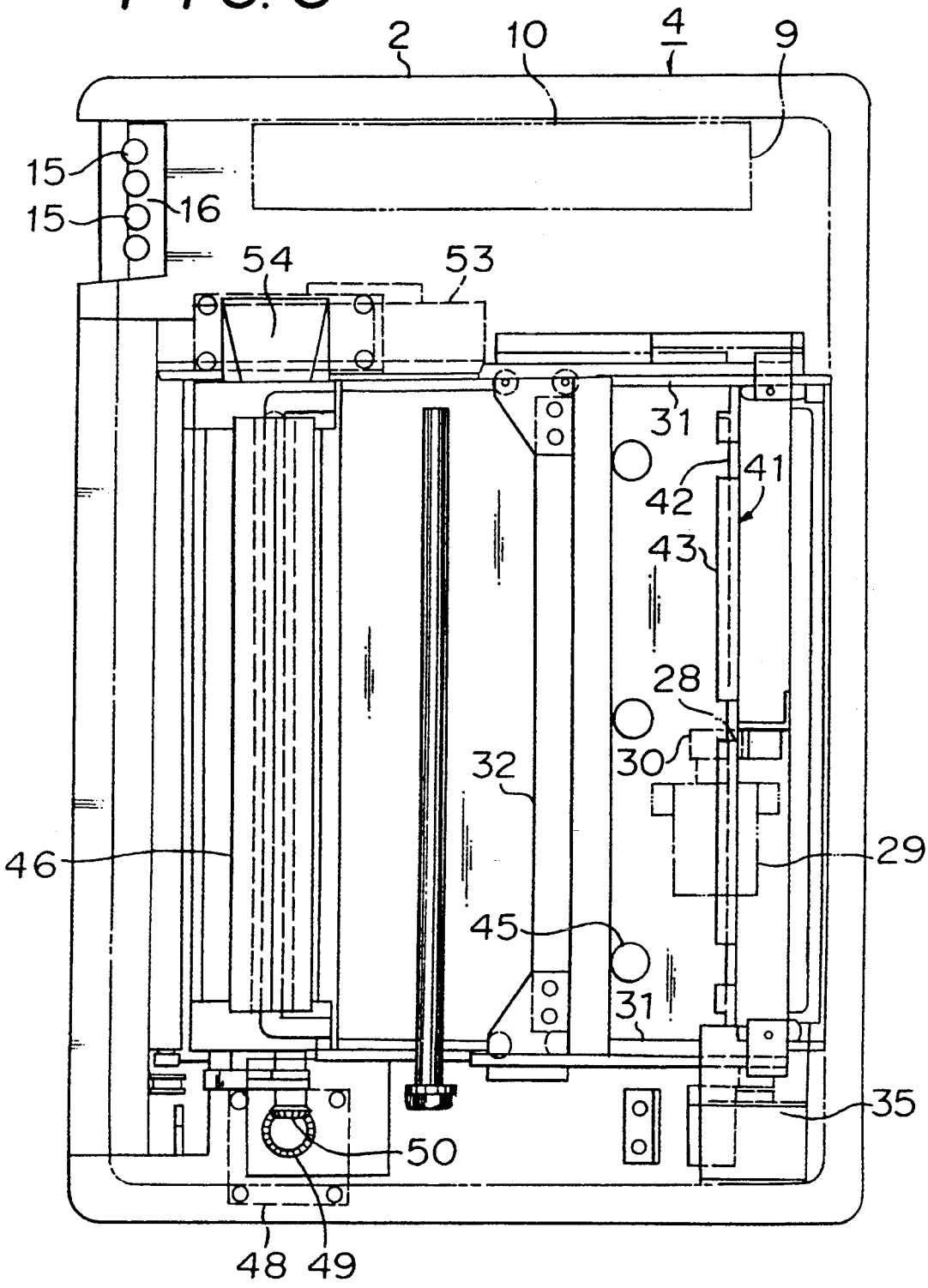
FIG. 3 is a sectional view of the embodiment taken along line 3—3 shown in FIG. 2.

FIG. 1 to FIG. 3 show one preferred embodiment of a film developing device according to the present invention.

In this embodiment, as shown in FIG. 1, the film developing device is provided with a dark chamber 4 which comprises a main body 2 having an operating panel 1 installed in the front surface thereof, and a dark chamber covering body 3 detachably installed on the main body 2.

In the front surface of the covering body 3, a front cover 6 having two circular holes 5 for inserting both hands into the covering body 3, is openably installed, and each of those holes 6 on the front cover 6 is covered with a cloth sleeve 7 for shutting out light. On the rear surface of the operating panel 1, a microcomputer (not shown) is installed.

As shown in FIG. 2 and FIG. 3, in the dark chamber 4, a spacing 10 for placing a sealed package 9 from which the undeveloped film 8 is taken out, is provided in the left upper portion thereof. Also, in the under portion of the dark chamber 4, the first vessel 11, the second vessel 12, the third vessel 13 and the fourth vessel 14 are installed in parallel toward the film processing direction, namely, from rear side to front side of the dark chamber 4. Each of these vessels has a sufficient sectional opening area and depth for submerging the film.

At the under portion of each of these vessels, one end of a flexible supplying pipe 15 is connected to each of the vessels, and the other end of each pipe 15 is passing through the lower left portion of the front surface of the main body 2 and is suspended on the pipe holder 16 installed on the external left surface of the main body 2 as shown in FIG. 1.

Further, as shown in FIG. 2, above each opening of the vessels 11, 12, 13 and 14, a covering plate 17 respectively installed thereon through a pin 18, and each of the four covering plates 17 is rotated around the pin 18 connected to a pair of connecting plates 21 placed on both sides of the vessels 11, 12, 13 and 14 through a pair of lug plates 19 integrated in one piece with the covering plate 17 through a pivot pin 20. Further, a pair of opening levers 22 are fixed on the specified position of each external surface of the connecting plates 21. Accordingly, by pushing the operating levers 22 upwardly and rearwardly, each covering plate 17 is lifted up as shown in FIG. 2 with two dotted lines, and each opening of the vessels 11, 12, 13 and 14 which is closed by the covering plate 17 is simultaneously opened.

Further, on the upper position against the fourth vessel 14, a switch 23 is installed for detecting an opened covering plate 17 which is simultaneously opened by the activation of the operating levers 22. Meanwhile, the first vessel 11, the second vessel 12, the third vessel 13 and the fourth vessel 14 are respectively filled with developing solution, the first washing water, fixing solution and the second washing water, and in each of the first and third vessels 11 and 13, a heater 24 is installed, and in the first vessel 11, a temperature detector 25 is also installed.

In the positions corresponding to the rear side of the dark chamber 4 and to both ends of the vessels 11, 12, 13 and 14, a pair of elevating levers 27 connected to a cross frame 26 at the upper ends thereof are movably installed horizontally on the main body 2 through guides (not shown). The cross frame 26 is one of members constructing the film processing and transferring means, and on the middle portion thereof is installed a rack member 28 oriented vertically. The rack member 28 is engaged with a pinion 30 installed on the motor shaft of a stepping motor 29 mounted on the main body 2 for driving the pair of the elevating levers 27. On both ends of the cross frame 26, both ends of a pair of guide arms 31 horizontally extending in the dark chamber 4 are securely fixed, and a clip holder 32 is movably hung between the pair of guide arms 31. The clip holder 32 is connected to the belt 37 which is wound around a roller 33 installed on the end portion of the cross frame 26, a roller 34 installed on the tip of the guide arm 37, and a driving roller installed on the motor shaft of a stepping motor 35 securely fixed on the upper end of the elevating lever 27.

Figure 4:
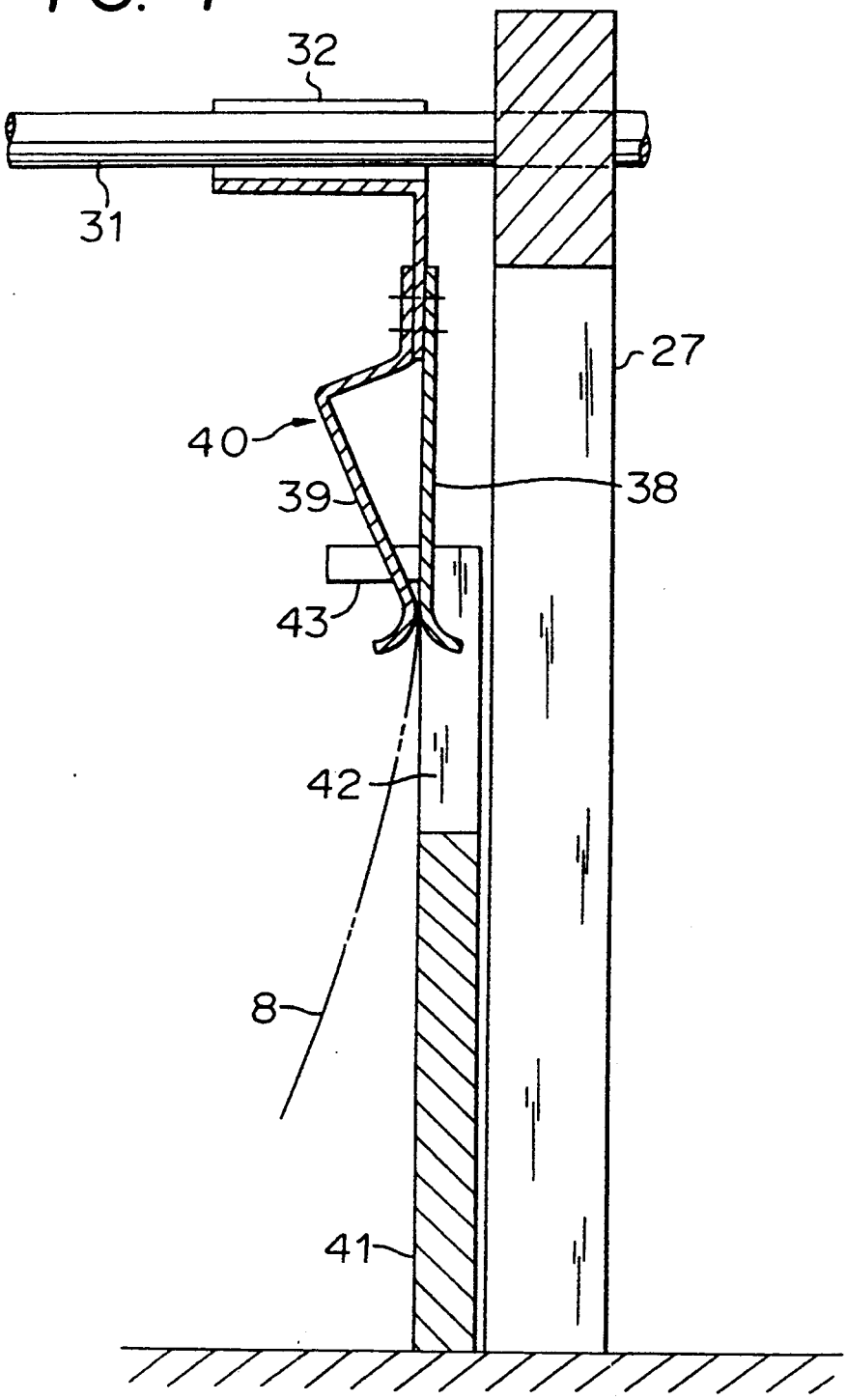
FIG. 4 is an enlarged sectional view showing the film clip and its vicinity of the embodiment shown in FIG. 1.

As shown in FIG. 4, on the clip holder 32, three film clips 40 are installed, and each of the clips 40 is composed with a rear nail 38 and a front nail 39. Meanwhile, on the front ends of the frame 26, a guide plate 41 for inserting the film 8 into a plural of the film clips 40 is vertically installed. On the upper portion of the guide plate 41, three portions 42 are cut for receiving the film clips 40 when the clip holders 32 are retreated, and a film stopping edge 43 is shaped for stopping the further intrusion of the film 8 into the clips 40 by making the upper edge of the film 8 contact the stopping edge 43. A plurality of switches 44 acting as sensors that detect if the film 8 is clipped properly in each of the film clips 40, are installed facing the film clips 40. Furthermore, on the upper portion of the main body 2, a plurality of holes 45 are shaped for receiving the film clips 40 when the frame 26 goes down, as shown in FIG. 3.

Figure 5:
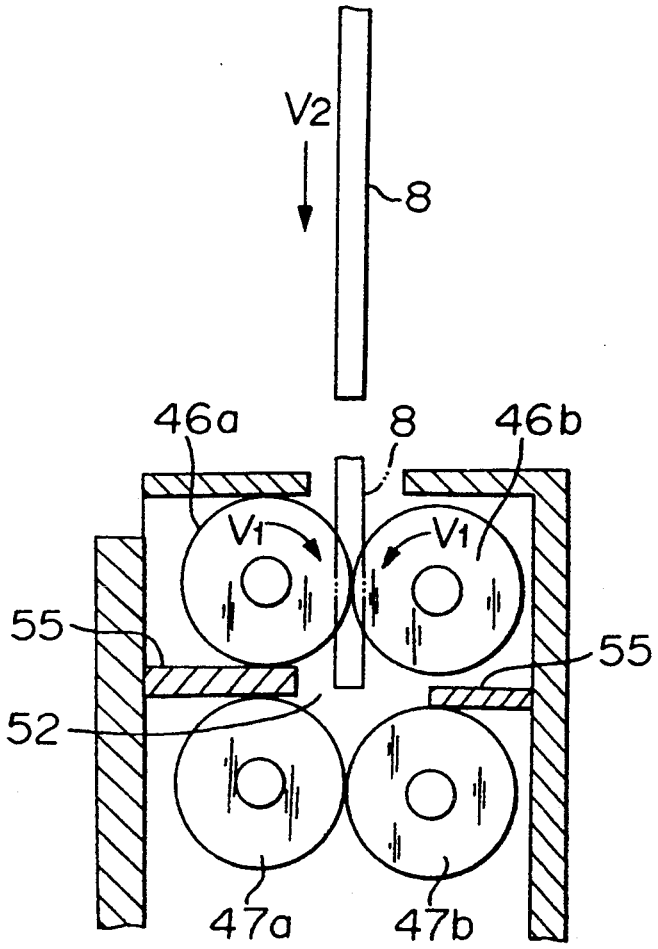
FIG. 5 is a partially enlarged sectional view of the drying means of the embodiment shown in FIG. 1.

Meanwhile, on the front side of the fourth vessel 14 are installed two pairs of nip rollers 46*a*, 46*b* and 47*a*, 47*b* arranged vertically with adequate distance. The nip roller 47*a* is driven by a spur gear (not shown) installed on the roller shaft thereof through a motor 48 vertically installed on the main body 2, and a driving bevel gear 49, a driven bevel gear 50 shown in FIG. 2. The nip roller 46*a* is driven by a spur gear (not shown) installed on the roller shaft thereof through an idling spur gear 51 and the spur gear (not shown) installed on the nip roller 47*a*. The nip rollers 46*b* and 47*b* are driven by contacting with the nip rollers 46*a* and 47*a*. As shown in FIG. 5, the peripheral speed V1 of the revolving nip rollers 46*a*, 46*b* and 47*a*, 47*b* are rated as a little than the downcoming linear speed V2 of the film 8, and the speed V1 and V2 are directed to the motor 48 and the stopping motor 29 from the microcomputer Mc.

Also, as shown in FIG. 5, on one end of each of the nip rollers 46*a*, 46*b* and 47*a*, 47*b* located in upper and lower positions, a hot air duct 54 supplying hot air from an air blower 53 which is one member of the drying means into a space portion 52 occupying an area between the nip rollers 46*a*, 46*b* and 47*a*, 47*b* is installed, and the hot air passes between a pair of blind plates 55 and the nip rollers 46*a*, 46*b* and 47*a*, 47*b*, and removed from a discharging port 57 via a below-mentioned chute 56. The air blower 53 is provided with a dehumidifying function, and it may be possible to be provided with a deodorizing function if needed. Also, under the pair of nip rollers 47*a*, 47*b* located in under position, a film discharging chute 56 which in the lower portion is bent frontwardly, is installed.

Furthermore, a microcomputer Mc is installed on the rear surface of the operating panel 1 of the main body 2, and the microcomputer Mc is one member of the operation controlling means, and controls the film processing and transferring means by an auto mode or a manual mode. In the auto mode, the microcomputer Mc selects the preset standard processing condition, at least in accordance with the qualitative state of either the developing solution in the first vessel 11 or the fixing solution in the third vessel 13, then controls aforementioned film processing and transferring means in accordance with the selected standard processing condition. In the manual mode, the microcomputer Mc controls the operation of the film processing and transferring means in accordance with the special processing condition directed by the operator.

Namely, in the auto mode, as the preset standard processing time or the processing condition in the processing solution classified in nine steps for determining the film concentration is stored in the microcomputer Mc, the concentration of the developed film is checked and compared with the preset concentration classified in nine steps, and the operation controlling means performs the process by the selected adequate submerging time, and such processing condition setting means is able to be programmed to automatically set the submerging time in the processing solution in accordance with the qualitative deterioration of the developing and fixing solutions accompanying the used frequencies. In this case, the standard processing condition is comprised with the developing time and the shuffling operation by the fingers when the experienced operator processes the film by hand. For example, in the standard processing condition, the ideal shuffling patterns such as speedy—slow—speedy—slow, or speedy—speedy—speedy, or slow—slow—slow are included.

Meanwhile, in the manual mode, the operation controlling means is performed in accordance with the specified processing condition directed by the operation. Namely, the film is processed in each of the processing solutions in accordance with the specified developing time and shuffling operations directed by the skilled operator.

Figure 6:
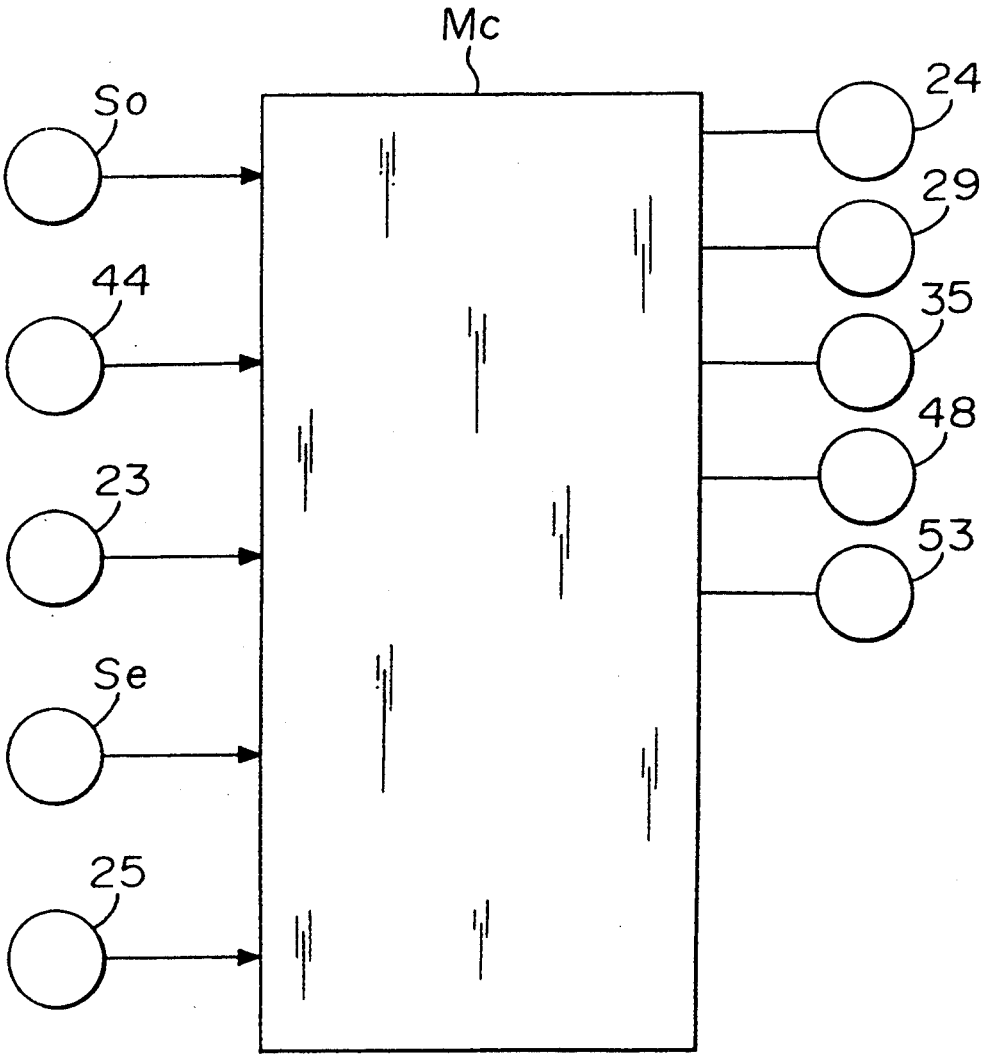
FIG. 6 is a block diagram of the controlling circuit of the embodiment shown in FIG. 1.

As shown in FIG. 6, a plurality of signals from a power source switch So, a switch 44 for detecting the condition of clipped film 8, a switch 23 for detecting the openings of the cover plates 17, and a temperature detection 25, are input in the microcomputer Mc. The heater 24 for heating the developing and fixing solution, the stepping motor 29 for horizontally moving the film 8, the stepping motor 35 for moving the film 8 forwardly, the motor 48 for driving the nip rollers 46*a* and 47*a*, and the air blower 53 for generating hot air are controlled by the microcomputer Mc by applying above-mentioned input signals. It may also be possible to compose the microcomputer Mc to receive transmitted signals from a frequency counter for counting the number of developed films, or a sensor for detecting the quality of each processing solution.

The working of the embodiment of the film developing device is described as follows.

The heater 24 is first activated by pushing the power source switch So, then the front cover 6 of the covering body 3 is opened as shown with the two dotted lines in FIG. 1. The package 9 containing the undeveloped X-ray film 8 is placed on the cover plates 17.

As shown in FIG. 1, the front cover 6 is then closed, and by inserting both hands into the dark chamber 4 through the holes 5, the film 8 is removed from the package 9, and the package 9 is placed on the spacing portion 10. Meanwhile, the film 8 is oriented sideways and pushed toward the guide plate 41, and further slid upwardly along the plate 41. Then the upper edge of the film 8 is inserted into each of the film clips 40, contacts with the stopping edge 43 and then the film 8 is automatically clipped with the film clips 40. The switch 44 is simultaneously activated, the signal is transmitted to the microcomputer Mc, and the LED (display lamp) on the operating panel 1 turns on and the electronic buzzer rings.

Next, in upwardly and rearwardly shifting the opening handle 22 of the connecting plate 21, each covering plate 17 is rotated around the pin 18, each of the vessels 11, 12, 13 and 14 are simultaneously opened, activated switch 23 transmits the signal to the microcomputer Mc, and the LED lamp L4 (red lamp) is turned off. When the temperatures of the developing and fixing solutions heated by the heater 24 reach the specified temperature, the LED L1 (red lamp) on the operating panel 1 turns off and the LED L2 (green lamp) on the operating panel 1 turns on.

By pushing the switching button B1 for switching to the auto mode the LED L5 (green lamp) on the opening panel 1 is turned on. By pushing the start button B6, the stepping motor 35 starts to revolve by the direction from the microcomputer Mc, the clip holders 32 move forward, and the film clips 40 are moved to the position above the first vessel 11 from the initial position wherein the film clips 40 contact the guide plate 41. In starting the stepping motor 29, the film 8 is submerged into the developing solution, and the stepping motor 29 repeats normal and reverse revolving for moving the film 8 toward horizontally and shuffling the film for the specified internal time and the specified horizontal speed. After the specified submerging time, the film 8 is raised up from the first vessel 11 by the revolutions of the stepping motor 28.

As the above operations are repeated, the film 8 is sequentially submerged and shaken in the first washing water, the fixing solution, and the second washing water. The film clips 40 clipping the film 8 are then transferred above the nip rollers 46*a* and 46*b* as shown in FIG. 2 with two-dotted lines.

The film-submerging time in each of the processing solutions is determined by the processing condition input in the microcomputer Mc, so that the processing time enables the films 8 to be treated so as to be finished in the specified condition.

The above-mentioned film-submerging time in each of the processing solutions is the standard processing time stored in the microcomputer Mc as the processing time enabling the film 8 to be finished in the same concentration as that of a film developed at standard processing time, or the processing time corresponding to any one selected from the concentrations classified in nine steps. Accordingly, as the development of the film 8 is automatically processed by the standard processing condition or the selected processing condition, the film is always uniformly processed.

As shown in FIG. 5, by then driving the stepping motor 29, the film 8 is forced to come down toward nip rollers 46*a*, 46*b* and 47*a*, 47*b* at a specified speed, and simultaneous with the start of the motor 48, the nip rollers start to revolve with a little faster peripheral speed than that of descending film 8. In this case, as the film 8 is nipped between the nip roller 46*a*, 46*b*, the drops of water adhering to the surface of the film 8 are sufficiently stripped, and the film 8 is dried with hot air supplied by the air blower 53 via the duct 54, then discharged into the front lower portion of the dark chamber 4 via the chute 56. The film 8 is further dried by hot air passing through the chute 56, and the film developing process is completed.

As the ejected film 8 is well dried, it is possible to further process the film 8 as it is. As above mentioned, with respect to the present invention, the film 8 is perfectly dehydrated by the differential between the descending speed of the film 8 and peripheral speed of the nip roller 46*a* and 46*b*, and further dried by hot air in the chute 56, and as a result the drying efficiency of the film 8 is very much increased.

Figure 7:
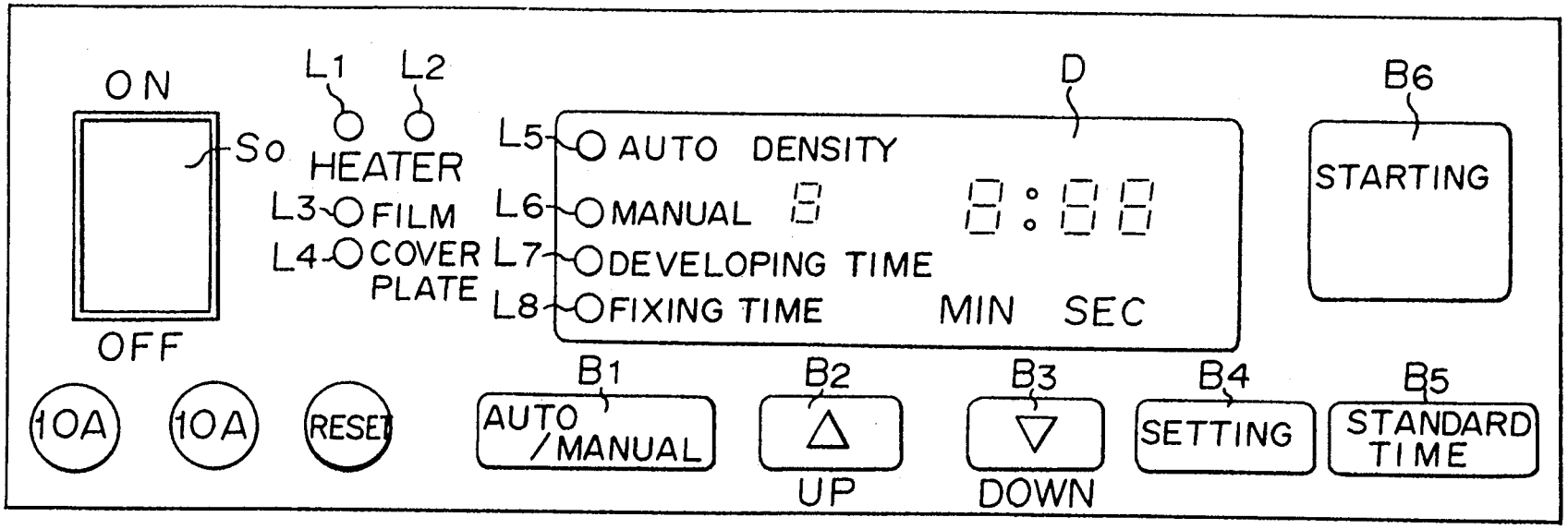
FIG. 7 is a plan view of the operating panel of the embodiment shown in FIG. 1.

The working of the microcomputer Mc is next described by referring to FIG. 6 to FIG. 8.

FIG. 8 is a flow diagram of the microcomputer built in this embodiment of the film developing device. As shown in FIG. 8, in pushing on the power source switch So on the operating panel 1 in step Po, the heater 24 for heating processing solutions is activated in step P01 and the temperature of the developing solution is displayed by turning off the LED L1 (red lamp) in step P 02, and LED L2 (green lamp) is turned on in step P03. In starting the stepping motors 29, 35, the film clips 40 are transferred to the original setting positions.

In step P1 the timers for respective operations are displayed, and in step P2, mode switching for auto mode or manual mode is judged.

In switching in the auto and in step P5, the standard processing time is displayed, then in step P4, as the film 8 is set as before mentioned, by pressing the switch 44, the process proceeds to step P5, and after confirming the opening of the cover plates 17 by the switch 23, the process proceeds to steps P6 and P7. If the cover plates 17 are not being opened, as the switch 23 does not transmit the signal into the computer, the process returns to step 05, and is reset. In resetting the switch 23, the process restarts from the stopped position.

In step P6, the air blower 53 is set to ON. Meanwhile, in step P7, in starting the stepping motor 35, the clip holder 32 and the film 8 clipped in the film clips 40 move forward to the position above the first vessel 11 via the rollers 33, 34 and 36 and the endless belt 37. Then, in starting the stepping motor 29, the frame 26 comes down via the pinion 30 and rack 28, and in step P8, the film 8 is submerged into the developing solution filled in the first vessel 11.

Next, in step P9, in revolving the stepping motor 24 in normal or reverse directions, the film 8 is shaken up and down. After the film 8 is shaken for a specified time, the process proceeds to step P10, and in activating the stepping motor 29, the film 8 is lifted up, and in activating the stepping motor 35, the clip holder 32 and the film 8 are transferred forward to the position above the second vessel 12.

Next, the same processing in steps P8, P9 and P10 are processed in steps P11, P12 and P13, and the film 8 is washed with the washing water filled in the second vessel 12.

Again, the same processing in steps P8, P9 and P10 are processed in steps P14, P15 and P16, and the film 8 is fixed with the fixing solution in the third vessel 13.

Further again, the same processes are repeated in steps P17, P18 and P19, and the film is washed with the washing water in the fourth vessel 14.

Next, in step P20, the film 8 comes down towards the nip rollers 46*a*, 46*b* and 47*a*, 47*b* and the nip rollers 46*a*, 46*b* nip the under edge of the film 8 and force-feed the film 8 downwardly by activating the motor 48, and the film 8 is dried in passing through the spacing portion 52, then ejected toward the front lower portion of the main body 2 via the chute 56. All processes are now finished and the processing flow returns to the first step P0.

Changes in the processing times are performed by the up and down button B2 and B3, and by pushing on the standard button B5, the standard time is displayed.

In step P2, in judging that the process is selected in manual operation, the process is advanced to step Q1 for selecting the developing time, the LED (yellow lamp) on the operating panel 1 is turned on, the display D on the operating panel 1 flashes, and the process proceeds to step Q3 through step Q2. In step Q3, the developing time is displayed in units of minutes, taking up one place, units of seconds by pushing the button B2 and down button B3, and the desired time is set by pushing the set button B4. In step Q4 the set time is recorded in the microcomputer Mc.

Next, in step Q5 for selecting the fixing time, LED L8 (yellow lamp) is turned ON and the display D flashes and then, the same as in steps Q3 and Q4, the fixing time is stored in the microcomputer Mc in step Q6 and Q7, and in step Q8 each processing time is displayed, and the process proceed to step P4, then the following process are performed the same as in the previously mentioned process.

In general, it is preferable to set the temperatures of solutions at 29° C. and the fixing time twice as long as the developing time.

If the solutions are deteriorated, it is necessary to elongate the developing time or fixing time while considering the state of deterioration and operation in accordance with experience, but when using either the auto mode or manual mode, the standard processing condition responding to the qualitative state of the processing solution is preciously stored in the ROM of the microcomputer Mc, and the processing condition in solution is selected in accordance with the qualitative state predicted or measured in every repetition of developing. Accordingly, in accordance with the selected processing condition in the solutions, the microcomputer Mc automatically controls the working of the film processing and transferring means.

Therefore, if the processing solutions have deteriorated, as the process is programmed in computerized stepped modes, it becomes possible to select adequate processing times in a one-touch operation.

Also, for obtaining clear exposure and for controlling the fixing time in units of seconds, it is possible to select the adequate processing time in a one-touch operation.

In the afore-mentioned first embodiment, the film developing device in which the openable cover plates 17 are installed on the upper portions of vessels 11, 12, 13 and 14 was described. Yet the present invention is not limited to closed vessels as in the first embodiment, as wipers 67 serving as a vessel cover may be applicable instead of covering plates 17.

In this second embodiment according to the present invention, with the exception of the wipers 67 and wiper opening means, the construction of the device is the same as in the first embodiment.

Figure 9:
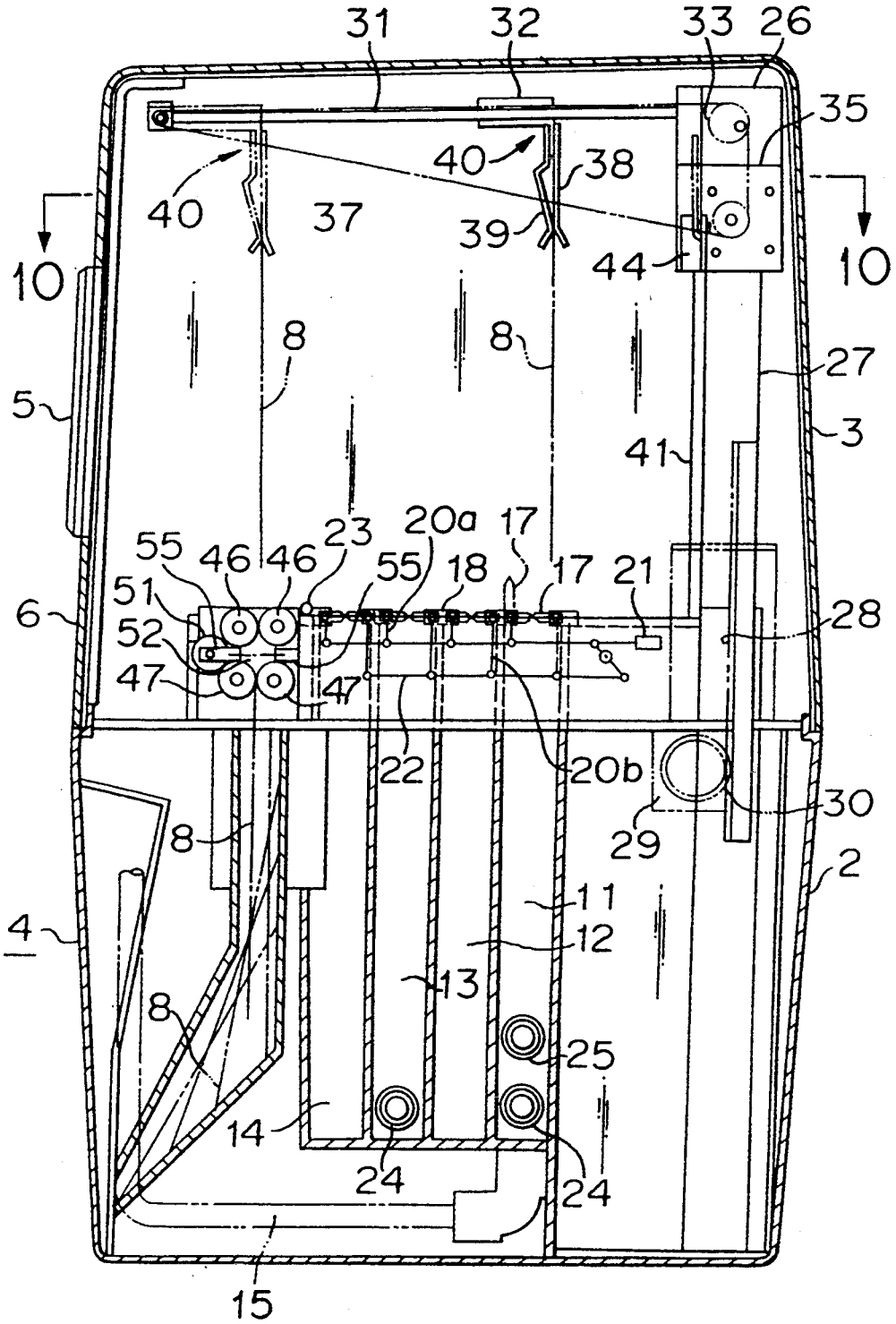
FIG. 9 is a side sectional view of another embodiment of the film developing device according to the present invention.
Figure 10:
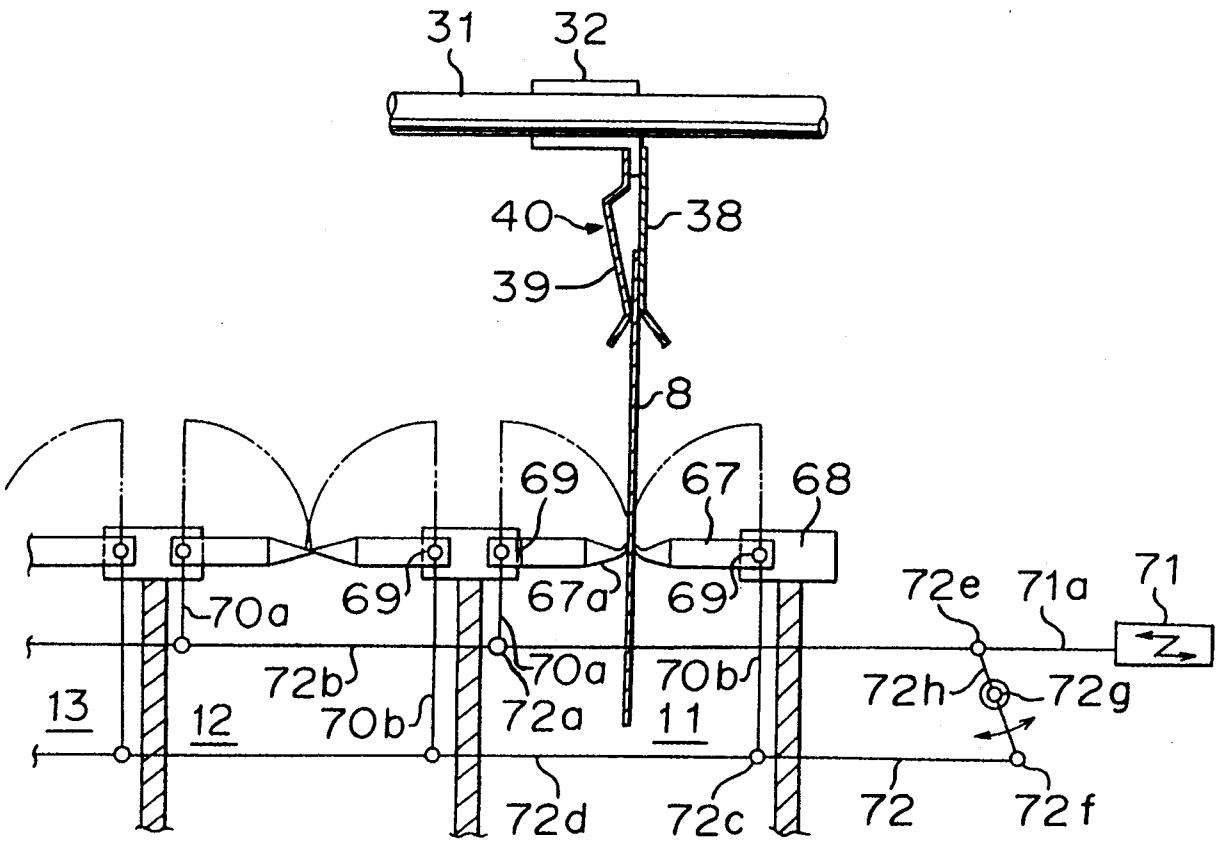
FIG. 10 is a sectional view of the essential parts of the embodiment shown in FIG. 9.

As shown in FIG. 9 and FIG. 10, on the upper portion of each of the vessels 11, 12, 13 and 14, a pair of wipers shaped like plates 67 enabling closure of the opening opened toward the dark chamber 4 with each side of the wipers. As shown in FIG. 10, on the one edge end of the wiper 67 facing the other, a triangular sectional wiping portion 67*a* made of flexible rubber and the like is installed, and each tip of the wiping portion 67*a* is a little overlapped with each other. Meanwhile, another end of the wiper 67 is rotatably supported on each wiper supporting member 68 installed on each of the side walls of each of the vessels 11, 12, 13 and 14 through a hinge pin 69, and a plural of levers 70*a* and 70*b* each having different lengths are fixed rectangularly to each of the wipers 67 and supported by each of the supporting members 68 to be freely swingable around each of the hinge pins 69. In closing each opening of the vessels 11, 12 13 and 14 by each of the wipers 67, each of the levers 70*a*, 70*b* is vertically orientated. Each of the suspended levers 70*a* and 70*b* is connected to an actuator 71 making each lever 70*a* and 70*b* swing, and a link mechanism 72.

The link mechanism 72 is comprised with: a horizontal first connecting lever 72*b* pivotally connecting each lower end of the four short levers 70*a* with four pins 72*a*; a horizontal second connecting lever 72*c* pivotally connecting each lower end of the four long levers 70*b* with four pins 72*c*; a link 72*h* pivotally connecting each end of the first connecting lever 72*b* and the second connecting lever 72*d* with pins 72*e* and 72*f*; a pin 72*g* positioned on the intermediate point of the link 72*h* dividing the length of the link 72*h* into the ratio of (length of the short lever 70*a*)/(length of the long lever 70*b*); and the pin 72*g* pivotally supporting the link 72*h*, one end of the first connecting lever 72*b* and a driving lever 71*a* of an actuator 1 being connected to the pin 72*a*. As mentioned above, the link mechanism 72 constructs means for opening each pair of wipers 67 together with the lever 70*a*, 70*b* and the actuator 71.

Furthermore, on the upper portion of the fourth vessel 14 is provided a switch 73 for detecting if the wipers 67 are being opened by activation of the wiper opening means.

In this embodiment, in pushing the start button B6 on the operating panel 1, the actuator 21 is activated, each of the vessels 11, 12, 13 and 14 is simultaneously opened, and the switch 23 transmits signals informing the microcomputer Mc that each of the vessels is opened.

When the developing and fixing solutions heated by the heater 24 reach the specified temperature, LED L1 (red lamp) on the operating panel 1 is turned off and LED L2 (green lamp) is turned on. As described above, each opening of the vessels 11, 12, 13, and 14 is simultaneously opened only while the processing is proceeding, and it is possible to prevent staining of the film 8 by the processing solution like drops of water adhered to the walls of the wipers. Also, when not used, as the openings are being closed, oxidation or deterioration of the processing solution is constrained and it is possible to elongate the life of each of the processing solutions. Furthermore, the space extending over the closed wipers 67 is possible to be used for taking out the film 8.

Next, by switching the auto mode/manual mode switching button B1 on the operating panel 1 to auto, the stepping motor 35 starts by direction from the microcomputer Mc, the clip holder 32 moves, and the film clips 40 are transferred to the position above the first vessel 11 from the original position contacting the guide plate 41. By starting the stepping motor 29, the actuator 71 and the link mechanism 72 open the wipers 67, and the film 8 is submerged in the developing solution in vessel 11 while guided by the wipers 67. Next, as the stepping motor 29 repeats normal and reverse rotations in specified time intervals, the film 8 is shuffled up and down in the developing solution at specified fast and slow speeds, and after the specified submerging time has elapsed, the film is raised upwardly from the first vessel 11 by the activation of the stepping motor 29, and a plurality of the wipers 67 are simultaneously closed by the wiper closing means. Then as the film 8 is nipped by tips of a pair of the wiping portions 67*a*, drops of the developing Solution adhering to the surface of the film 8 are wiped, and the wiped drops drop into the original vessel 11. Owing to this wiping action, consumption of the developing solution and transferal of the solution to the second vessel 12 are prevented. Contamination of the washing water is also prevented.

As described above, the present invention includes a plurality of vessels, processing condition setting means, and film processing and transferring means, the film 8 is sequentially submerged in each of the vessels, and is shuffled in accordance with the processing condition corresponding to the qualitative state of each of the processing solutions. Accordingly, it becomes possible to prevent injury to the film 8, and to perform the developing process by the same shuffling operation performed by hand.

Also, as each Of the vessels are provided with openable cover plates, the film removal operation in the dark chamber is easily performed in the space above the closed vessels, and the deterioration of the processing solutions and the contamination of the inner sides of the dark chamber are preventable.

Furthermore, as the processing condition corresponded to the qualitative state and change of each of processing solutions is set by the processing condition setting means, it is possible to always develop uniformly regardless of the operator's experience.

In the device of the invention, as the film is automatically clipped in the film clips with one touch by upwardly guiding the film along the guide plate, it is possible to easily hold the film by film holding means in the dark chamber. It is also possible to detect and to display whether the film is correctly held by the film holding means, making it is possible to confirm whether the holding means is correctly holding the film or not.

Moreover, as the cover plate is closable individually, each opening located on the upper portion of the vessels is simultaneously opened only while the developing process is performed by activating the cover plate opening means, it is possible to prevent damage to the film with the processing solution, and also to prevent deterioration of the processing solutions due to oxidization by closing the vessels by the cover plate when not in use. Further, when not in use, as a space is shaped on the closed vessels, it is possible to easily remove the film from the package by using the space, and in processing the film, as each of cover plates stands vertically, it is possible to apply the cover plates as a guide for submerging the film.

The device or invention is preferably provided with two pairs of rollers revolving at a faster peripheral speed than the transferring speed of the film and the circulated hot air drying means, it is possible to strip drops of water from the film and to dry the film sufficiently in a short time, and to further drastically increase drying efficiency by redrying the film in the chute to which the film-drying hot air is discharged.

In addition, as film processing and transferring means for processing and transferring the film and operation controlling means for controlling the operation of the film processing and transferring means are provided, it is possible to automatically control the operation of film processing and transferring means in accordance with a specified processing condition directed by the operator and the qualitative state of the processing solutions. It is also possible to select the adequate processing time with one touch since the selection of the processing time is modified in a series of steps by the microcomputer. In requiring the fixing time to be controlled in units of seconds for obtaining clear exposures, it is possible to select the adequate processing time with one touch.

Also, as the cover plates individually shuffling each of the openings installed on upper portions of the vessels are opened simultaneously only while processing, by activating vessel opening means it is possible to prevent damage to the film by the processing solution, and also to prevent deterioration of the processing solution due to oxidization by closing the vessels by the cover plate when not in use. Also, when not in use, as a space is shaped on the closed vessels, it is possible to easily remove the film from the package by using the space, and in processing the film, as each cover plate stands vertically, it is possible to apply the cover plates as guides for submerging the film.

While the present invention has been described hereinabove only with respect to two preferred embodiments, it should be of course understood that it should not be limited only to such embodiments, and many changes and modifications may be made to the invention without any departure from the spirit and scope thereof.

What is claimed is:

1. A film developing device for highly sensitive film, such as an X-ray which comprises:

a dark chamber for processing film in which the development is conducted in a series of process steps including at least developing the film, washing the developed film with water, fixing said developed film, washing said fixed film again with water, and then drying the film thus processed;

a plurality of vessels disposed in parallel with the bottom of said dark chamber, said vessels containing one of each processing solution, namely, developing solution, water, fixing solution and water in such order downstream of the processing direction;

a film holding means for holding film for processing the film in said dark chamber;

a transferring means for transferring said held film into said developing solution for development, transferring the developed film into water for washing, transferring the washed film into the fixing solution for fixing, transferring the fixed film into water for a second washing, and transferring the processed film for dewatering;

a shuffling means for shuffling said film with a stepping motor in each vessel of processing solution so that the film is completely processed, and said stepping motor being rotated back and forth periodically;

a processing condition setting means for determining with a microcomputer time periods for processing of said film in the developing solution and/or the fixing solution, and for determining the rotational speed of said stepping motor for shuffling said film so that predetermined processing can be attained even when the processing solutions have deteriorated over repeated processing;

a dewatering means for dewatering moisture on the surface of the twice-washed film with a plurality of nip rollers; and a drying means for drying the processed film.

2. The film developing device as claimed in claim 1, wherein said film-holding means comprises a guide plate which is vertically installed in a rear upper place in said dark chamber, along which undeveloped film is manually slid up to be held in the film holding means;

a film-detecting sensor installed on said guide plate for detecting whether or not said undeveloped film is held in a correct position by said film-holding means; and a display means receiving signals from said film-detecting sensor and indicating whether or not said undeveloped film is held by said film-holding means at said correct position.

3. The film developing device as claimed in claim 1 wherein each of said vessel is provided with an openable cover plate disposed at the top of each vessel and said cover plates are opened prior to the processing of said film to be developed.

4. The film developing device as claimed in claim 1 further including a pair of wipers on top of each vessel being opened when said film is processed, and closed at least when said washed film is taken out from any processing solution or water, each tip thereof comprising flexible rubber in the shape of a triangular pyramid, and each tip of said wipers overlapping each other, whereby any solution adhering to the surface of the film is stripped away when said film is nipped by said pair of wipers and taken out of the said solution.

5. The film developing device as claimed in claim 1, wherein said dewatering means is disposed adjacent to the second washing vessel in the dark chamber, said nip rollers comprise two pairs which are provided horizontally, and perpendicular to the downstream processing direction and parallel to each other, and said nip rollers revolving at a faster peripheral speed than the transferring speed of film downwardly, whereby water on the film is stripped away by said nip rollers.

6. The film developing device as claimed in claim 1, wherein said plurality of nip rollers include two pairs of nip rollers.

7. The film developing device as claimed in claim 1, wherein said drying means is conducted by means of a hot air blower.

8. The film developing device as claimed in claim 4, wherein said pair of wipers are also closed when no film processing is being performed by said device.

* * * * *